US005616875A

United States Patent [19]

Lombardi

[11] Patent Number: 5,616,875

[45] Date of Patent: Apr. 1, 1997

[54] DRUM STRAND TENSIONER

[75] Inventor: Donald G. Lombardi, Thousand Oaks, Calif.

[73] Assignee: Drum Workshop, Inc., Oxnard, Calif.

[21] Appl. No.: 567,969

[22] Filed: Dec. 6, 1995

[51] Int. Cl.[6] ..... G10D 13/02

[52] U.S. Cl. ..... 84/415

[58] Field of Search ..... 84/411 R, 415

[56] References Cited

U.S. PATENT DOCUMENTS 2,621,554 12/1952 Way ..... 84/415

4,339,982 7/1982 Hoshino ..... 84/415

4,383,467 5/1983 Glassford, Jr. ..... 84/415

*Primary Examiner*—Cassandra C. Spyrou

*Attorney, Agent, or Firm*—William W. Haefliger

[57] ABSTRACT

A throw-off device for use on a drum having a side wall and a head, which includes a support body attachable to the side wall of the drum; a lever having pivotal attachment to the body; an adjustable tensioning member connectible to a strap that tensions or releases strands extending adjacent the drum head; the member having operative guided relation with the body and operative connection with the lever to tension the strap and strands when the lever is swung toward the support body, and to de-tension the strap and strands when the lever is swung away from the support body.

13 Claims, 3 Drawing Sheets

3
10
55a'
55
33
36a
36a
36
36
25
25
47
46
11
44
2
70
59
58
46a
2
3

55
59

58
46a
57
21
44
~13~
10
46a

DRUM STRAND TENSIONER

BACKGROUND OF THE INVENTION

This invention relates generally to drumming apparatus, and more particularly to auxiliary apparatus attachable to a drum, such as a tom-tom, for tensioning and releasing multiple strands that coact with the drum head to produce desired acoustic effects.

There is need for improved, simple, effective auxiliary means that a drummer may use to quickly tension and/or release strands, such as metal wires, that are used adjacent a drum head to produce certain distinctive acoustic effects, upon beating a drum, as for example a tom-tom drum.

More particularly, there is need for an adjustment that will allow adjustable tensioning of such strands, for tuning of the desired acoustic effects.

SUMMARY OF THE INVENTION

It is a major object of the invention to provide improved auxiliary apparatus meeting the above needs. Basically, the improved apparatus or device of the invention comprises:

a) a support body attachable to the side wall of the drum, b) a lever having pivotal attachment to the body, c) a tensioning member connectible to a strap that tensions or releases strands extending adjacent the drum head, d) the member having operative guided relation with the body and operative connection with the lever to tension the strap and strands when the lever is swung toward the support body, and to de-tension the strap and strands when the lever is swung away from the support body. The member is adjustable to adjust such tension.

Another object of the invention is to provide an improved device, as referred to, wherein the tensioning member has a first portion guided for linear movement by a guide on the body, and a second portion pivotally connected to the lever, in spaced relation to the pivotal attachment of the lever to the body. As will appear, the tensioning member may have a third portion attached to the strap, and such first and second portions typically may have adjustable interconnection, for varying the spacing between the pivotal attachment of the lever to the body and the pivotal attachment of the member second portion to the lever.

A further object is to provide the second portion with pivotal attachment to the lever comprises a link means swung over-center relative to the pivotal attachment of the lever to the body in response to completed swinging of the lever toward the body.

Yet another object is to provide a highly compact device wherein the lever forms a cavity into which the tension-adjusted member is received upon completed swinging of the lever toward the body.

The device of the invention may be attached to one side of the drum wall in sidewardly spaced relation to the drum head, whereby the tensioning strap extends directly to the strands overlying the drum head, such strands typically consisting of a set of parallel, flexible wires or wire coils, and an auxiliary strap connects the wires to the opposite side of the drum wall.

These and other objects and advantages of the invention, as well as the details of an illustrative embodiment, will be more fully understood from the following specification and drawings, in which:

DRAWING DESCRIPTION

DETAILED DESCRIPTION

Figure 1:
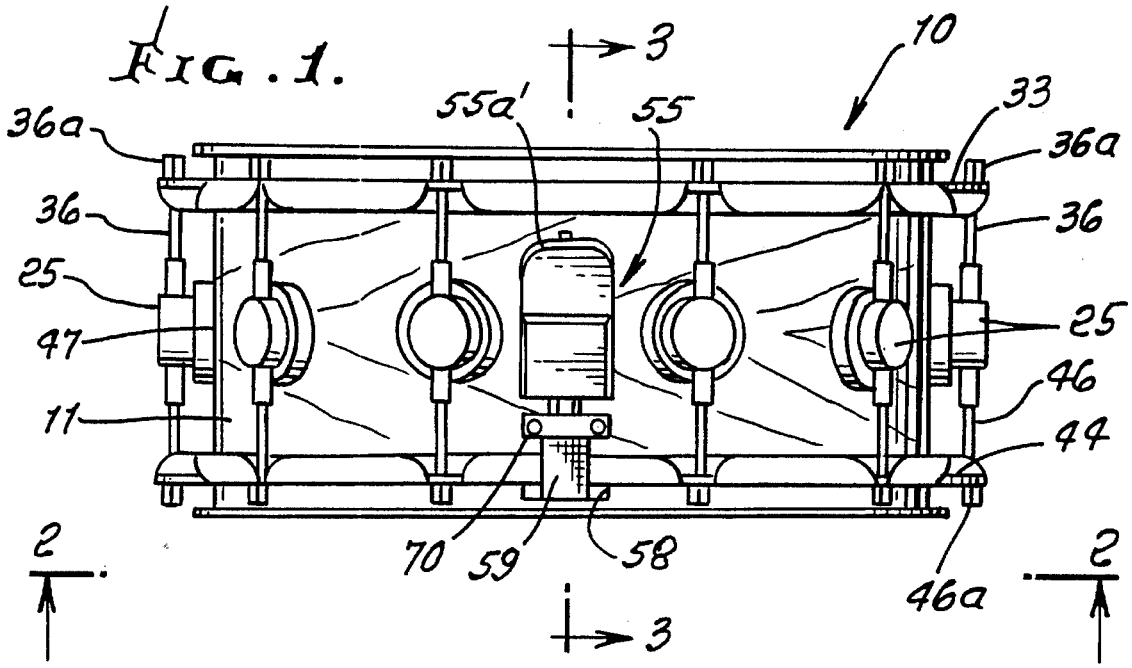
FIG. 1 is a side elevational view of a drum incorporating the invention.
Figure 2:
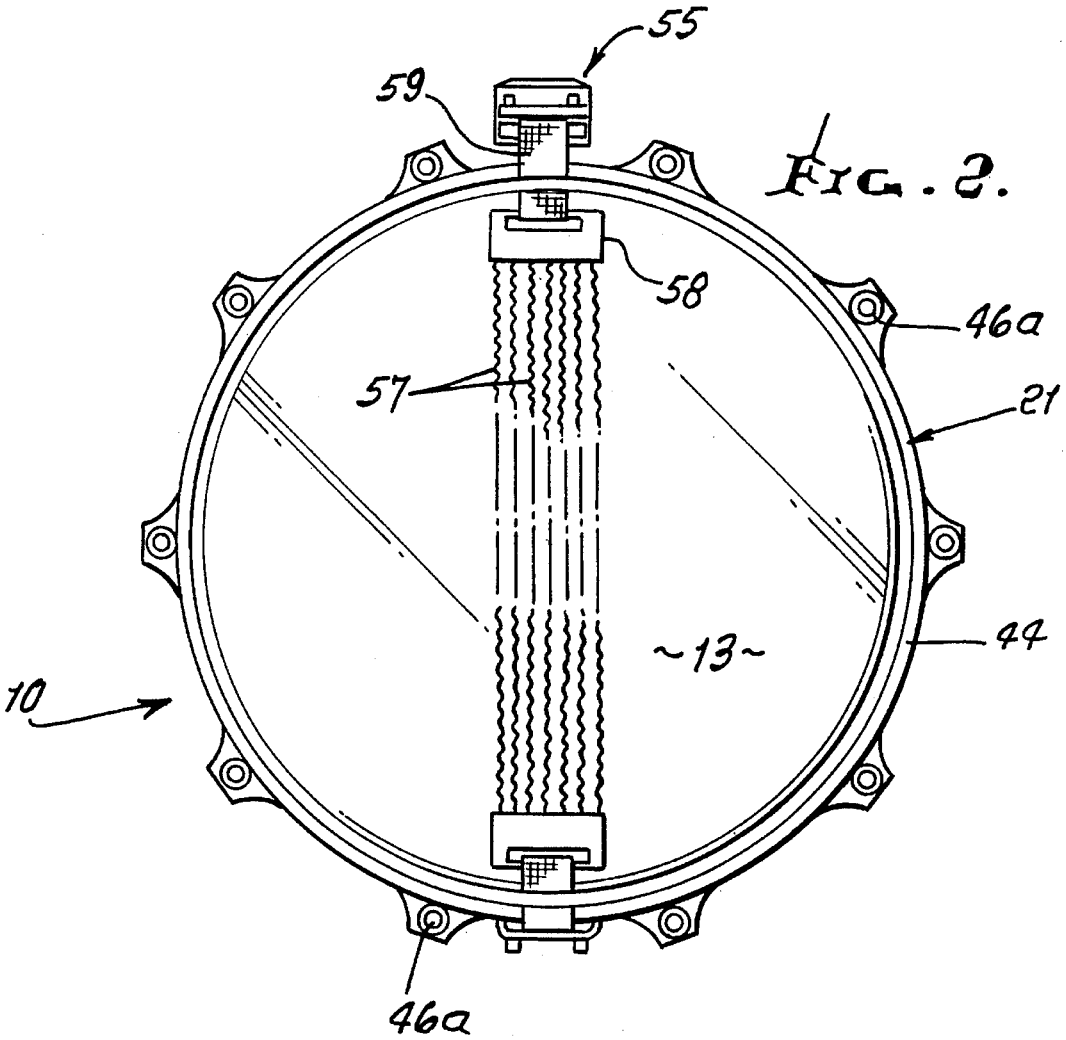
FIG. 2 is a plan view taken on lines 2—2 of FIG. 1.

In the drawings, a drum 10 has a shell 11 comprising a cylindrical section or sections located in axially extending position. Drum 10 may be a tom-tom.

Figure 3:
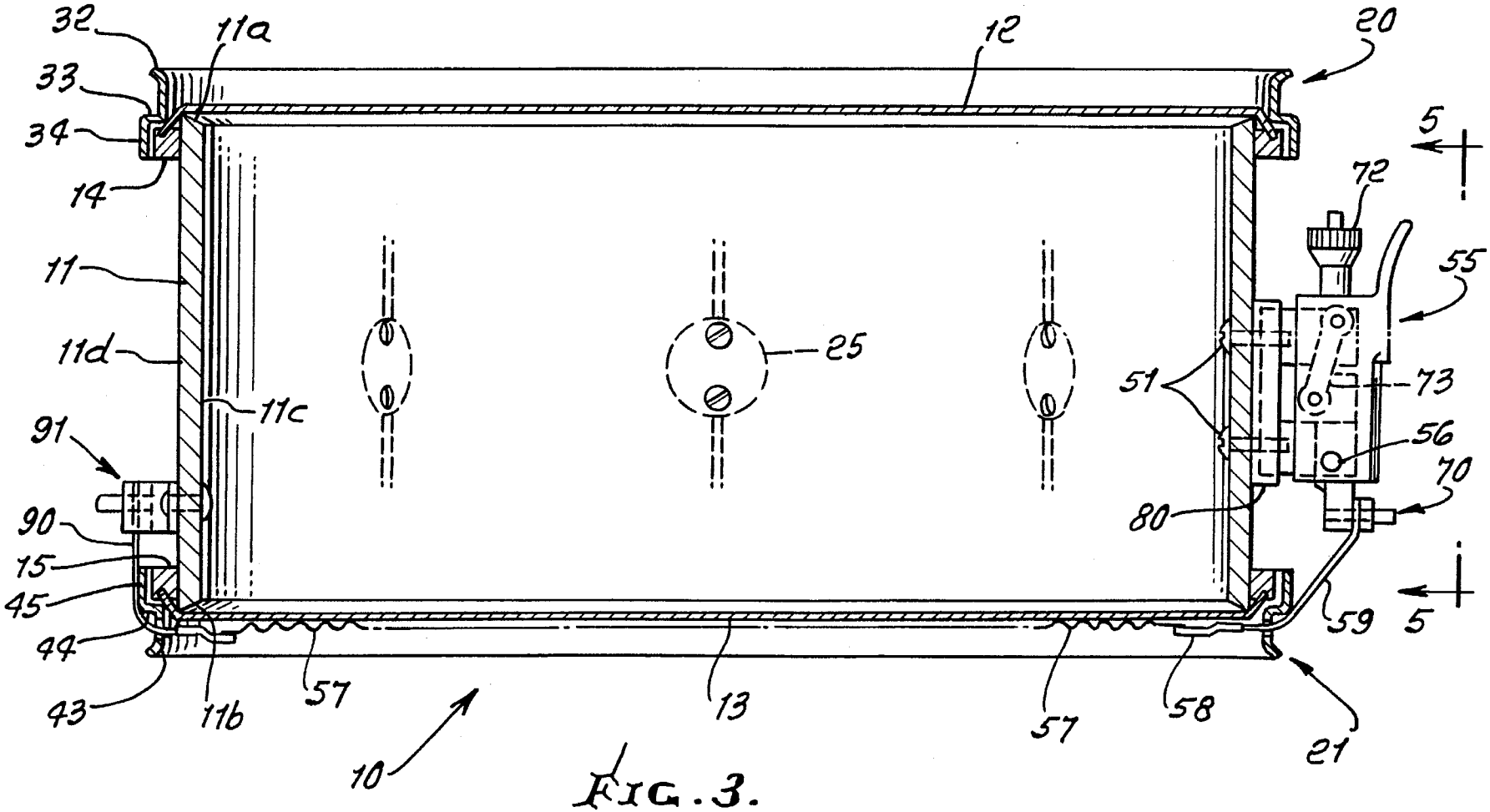
FIG. 3 is an enlarged vertical section taken on lines 3—3 of FIG. 1.

Opposite annular and inwardly angled ends of the shell appear at 11*a* and 11*b* in FIG. 3. The shell typically consists of wood and has inner and outer cylindrical walls 11*c* and 11*d*.

Drum heads 12 and 13 extend over the shell ends 11*a* and 11*b* and are retained in taut condition. They may consist of thin sheets of plastic or other material. Annular metallic flanges 14 and 15 are typically attached to the respective heads 12 and 13 for retaining them in taut condition. Flanges 14 and 15 extend about opposite end extents of the shell, as seen in FIG. 3.

The retainer structure shown includes flange structure 20 provided in association with one end 11*a* of the shell, and flange structure 21 in association with the other end 11*b* of the shell.

The upper flange structure 20 has an upwardly extending annular rim portion 32 extending above the level of drum head 12, a medial annular portion 33 extending radially outwardly below the level of 32, for transmitting head tightening loading to flange 14, and a lower annular extending portion 34 extending downwardly from the outer extent of 33. A tightening adjustment fastener rod 36 extends downwardly through 33 and has external threads that interfit upper internal threads in holder or stud 25. Note fastener head 36*a* bearing on the upper surface of 33 in FIG. 1. The lower surface of 33 exerts downward loading onto retention ring or flange 14 to which drum head 12 is attached, for adjusting its tautness, by drawing the head over 11*a*.

Likewise, lower flange structure 21 has a downwardly extending annular rim portion 43 extending below the level of drum head 13, a medial annular portion 44 extending radially outwardly above the level of 43 for transmitting head tightening loading, and an upper annularly extending portion 45 extending upwardly from outer extent of 44. A tightening adjusting fastener rod 46 extends upwardly through 44 and has external threads that interfit rotatably lower internal threads in holder or stud 25. Note fastener head 46*a* bearing on the lower surface of 44. The upper surface of 44 exerts upward loading onto lower retention ring or flange 15 to which drum head 13 is attached, for adjusting its tautness, i.e., over bevel 11*b*. Fasteners connect 25 to 11 at 47. Accordingly, the drum heads are individually adjustable, and acoustic benefits are enabled, while the drum heads are stretched over metal edges, with acoustic benefits.

Figure 4:
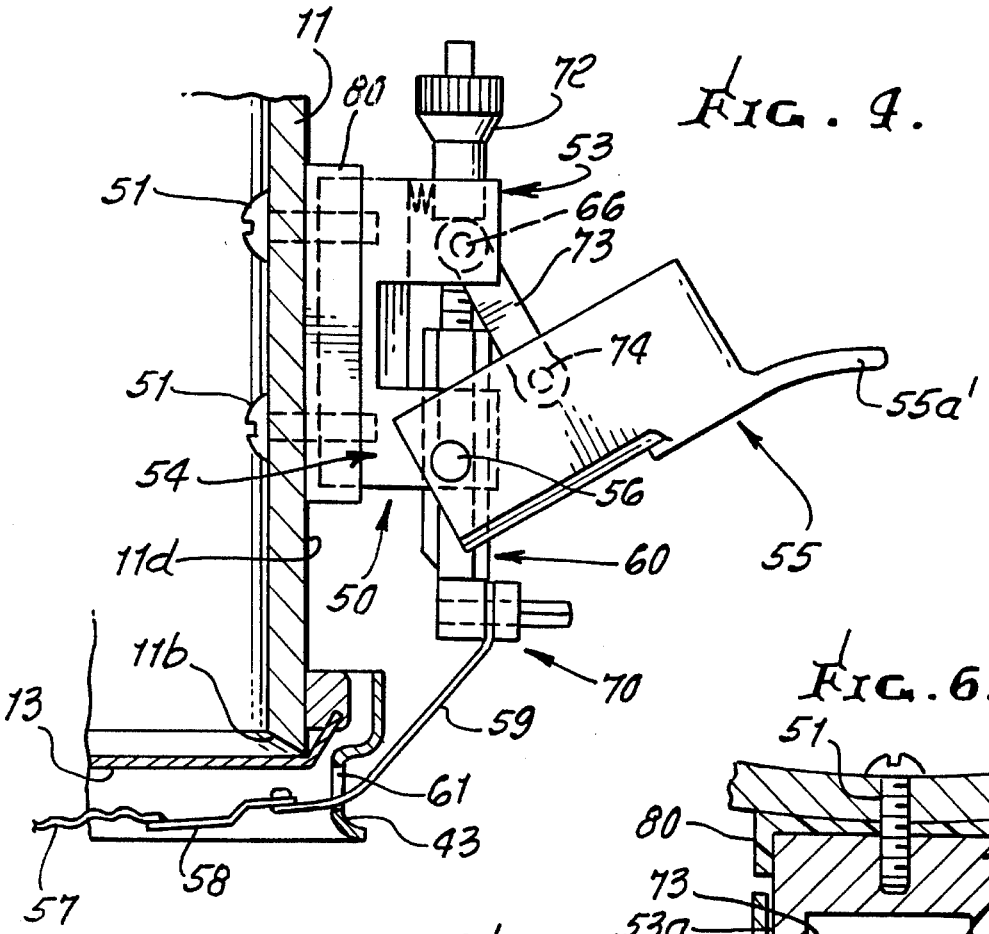
FIG. 4 is an enlarged fragmentary section showing lever structure to tension a strap and metal strands adjacent a drum head.
Figure 6:
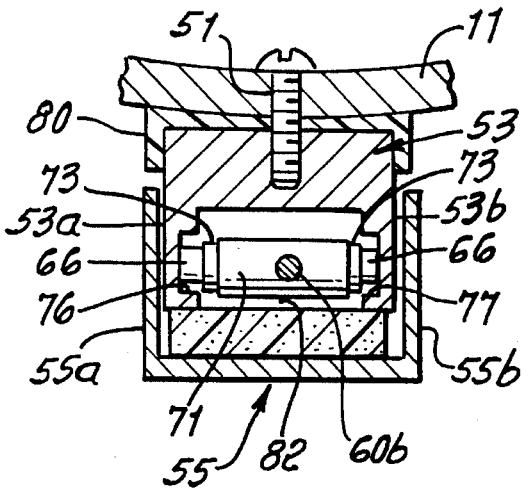
FIG. 6 is a horizontal section taken on lines 6—6 of FIG. 5.
Figure 5:
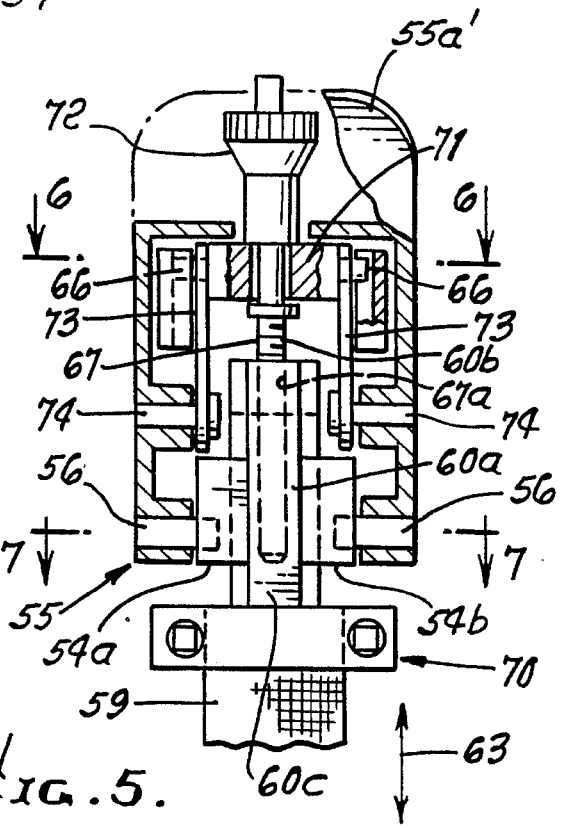
FIG. 5 is an enlarged side elevation taken on lines 5—5 of FIG. 3.
Figure 7:
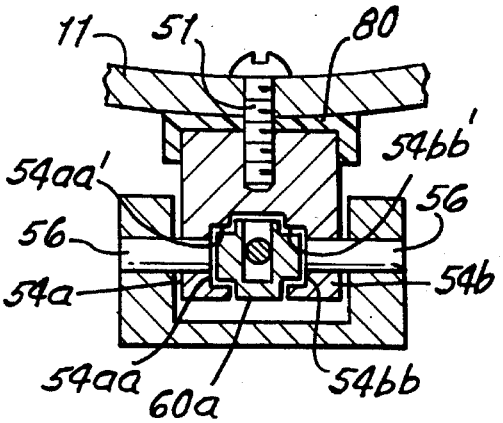
FIG. 7 is a horizontal section taken on lines 9—9 of FIG. 5.

Referring to FIGS. 3–7, and in accordance with an important feature of the invention, a support body 50 is attached, as by fasteners 51, to the outer side 11*d* of wall 11 of the drum, above the bottom level 11*b* of that wall. A pad 80 positions the body, as seen in FIG. 7. Body 50 projects radially outwardly and has upper and lower legs 53 and 54, which are vertically spaced apart. A lever 55 has pivotal attachment to the body, as for example by means of pivot pins 56 extending from lower sections 55*a* and 55*b* into sections 54*a* and 54*b* of body lower leg. The lever is thereby enabled to swing between release position seen in FIG. 4, in which strands 57 adjacent the lower head 13 are de-tensioned, and activated position, seen in FIG. 3, in which strands 57 are tensioned for acoustically striking the head 13 upon beating of the drum head 12. In FIG. 4 the lever is swung away from the drum side wall, whereas in FIG. 3, the lever is swung toward the drum side wall.

The ends of the strands 57 closest to the lever are connected at 58 to a strap 59 operatively connected to the lever. As shown, a tensioning member 60 is connected by releasable clamp 70 to the upper end of strap 59, the lower end of that strap extending through an opening 61 in the drum lower rim portion 43. Member 60 has operative connection with the lever to tension the strap and strands, when the lever is swung toward the support body, and to de-tension the strap and strands, when the lever is swung away from support body. Note lever handle 55*a*.

The tensioning member has a first or upper portion, as at 60*a*, guided for linear movement by a guide on the body 50, such a guide being provided by the inner side walls 54*aa* and 54*bb* of sections 54*a* and 54*b*, respectively.

FIG. 7 shows the lateral protruding sides of 60*a* fitting in guide grooves 54*aa'* and 54*bb'* of 54. See the arrow 63 in FIG. 5 indicating the directions of guided movement in FIG. 5. Member 60 also has a second portion, as at 60*b*, operatively pivotally connected to the lever, as at pivot locations 66, in spaced relation to the pivotal attachment of the lever to the body (at pins 56). The member 60 also has a third and lower portion 60*c* attached to the strap.

It will be noted that the tensioning member first and second portions (as at 60*a* and 60*b*) have adjustable interconnection, for varying the spacing between the pivotal attachment at 56 of the lever to the body, and the pivotal attachment at 66 of the member portion 60*b* to the lever. See for example the external threads 67 on second portion 60*b* that rotatably interfit internal threads 67*a* on member first portion 60*a*.

A rotary adjusting part 72 is integral with portion 60*b* to rotate it relative to portion 60*a*, thereby moving captivated trunnions 71 in the direction of arrow 63, carrying pivots 66 toward or away from 56. The connection to the lever includes link means, such as the two links 73 having upper ends connected to pivots 66 on the trunnions, and lower ends connected via pivots 74 to the lever, in offset relation to pivots 56. See FIG. 4.

Pivots 66 also extend in guide tracks 76 and 77 provided by the body leg 53 upper sections 53*a* and 53*b*. See FIG. 6. The construction facilitates adjustable tensioning of the strands 57, in superposed relation to tightening and loosening of the strands facilitated by closing and opening of the lever.

In this regard, it will be noted that the member 60 pivoted connection to the lever allows the link means to be swung over-center relative to pivotal attachment of the lever to the body in response to completed swinging of the lever toward said body.

See the over-center locking position of the lever in FIG. 3, in which the strands 52 are resiliently tensioned. The lever forms a cavity 82 into which the tensioning member is received upon completed surveying of the lever toward the body 50. See FIG. 6 showing lever side walls 55*a* and 55*b* at opposite sides of the member 60 part 60*b*, to protect member 60.

An auxiliary strap 90 is connected to the strands remotely from the lever, and means connecting the auxiliary strap to the drum wall remotely from the lever is provided at 91.

I claim:

1. A throw-off device for use on a drum having a side wall and a head, comprising a) a support body attachable to the side wall of the drum, b) a lever having pivotal attachment to the body, c) a tensioning member connectible to a strap that tensions or releases strands extending adjacent the drum head, d) said member having operative guided relation with said body and operative connection with the lever to tension said strap and strands when the lever is swung toward said support body, and to de-tension said strap and strands when the lever is swung away from said support body, e) said member being adjustable to adjust strap and strand tension, f) said tensioning member having a first portion guided for sliding movement by a guide on said body, and a second portion movably connected to the lever, and in spaced relation to said pivotal attachment of the lever to said body.

2. The device of claim 1 in combination with said drum, said body rigidly attached to said side wall.

3. The device of claim 1 wherein said sliding movement is linear and said second portion is pivotally connected to the lever.

4. The device of claim 3 wherein said tensioning member has a third portion attached to said strap.

5. The device of claim 4 wherein said tensioning member first and third portions have adjustable interconnection, for varying the spacing between the pivotal attachment of the lever to the body and the pivotal attachment of the member second portion to the lever.

6. The device of claim 3 wherein said second portion pivoted connection to the lever comprises a link means swung over-center relative to said pivotal attachment of the lever to said body in response to completed swinging of the lever toward said body.

7. The device of claim 5 wherein said second portion pivoted connection to the lever includes link means swung over-center relative to said pivotal attachment of the lever to said body in response to completed swinging of the lever toward said body.

8. The device of claim 1 wherein the lever forms a cavity into which said tensioning member is received upon completed swinging of the lever toward said body.

9. The device of claim 3 including said drum, said strap and said strands.

10. The device of claim 6 including said drum, said strap and said strands.

11. The device of claim 10 wherein said strands consist of metal wires.

12. The device of claim 9 including an auxiliary strap connected to the strands remotely from said lever, and means connecting the auxiliary strap to the drum remotely from the lever.

13. In combination:

a) a support body attachable to the side of a drum, said body extending vertically, and having lower legs which define vertical guide surfaces, and upper legs which define vertical track surfaces, b) a lever having pivotal attachment to said body to define a first horizontal pivot axis, c) a tensioning means having first, second and third portions, the first portion having vertical guided relation with said vertical guide surfaces, the second portion extending proximate said track surfaces, and there being trunnions on said second portion which have guided relation with said track surfaces, said third portion operatively connectible to strands that extend adjacent a drum head, for tensioning said strands, d) there being link means having pivoted connection to the tensioning means second portion, and having pivoted connection to the lever in offset relation to said first horizontal axis, e) said first and second portions of said tensioning means having adjustable interconnection allowing adjustment of the spacing between said first horizontal axis, and said link pivoted connection to the tensioning means second portion, f) whereby adjustment of said first tensioning means serves to adjust the tension of said strands.

* * * * *